US010094576B2

(12) United States Patent
Kim et al.

(10) Patent No.: US 10,094,576 B2
(45) Date of Patent: Oct. 9, 2018

(54) COOKING APPLIANCE

(71) Applicant: LG ELECTRONICS INC., Seoul (KR)

(72) Inventors: Wontae Kim, Seoul (KR); Wansoo Kim, Seoul (KR); Byungkyu Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 410 days.

(21) Appl. No.: 14/856,069

(22) Filed: Sep. 16, 2015

(65) Prior Publication Data

US 2016/0146474 A1 May 26, 2016

(30) Foreign Application Priority Data

Nov. 21, 2014 (KR) ..... 10-2014-0163278

(51) Int. Cl.
*F24C 15/32* (2006.01)
*F24C 13/00* (2006.01)

(52) U.S. Cl.
CPC ..... *F24C 15/327* (2013.01); *F24C 13/00* (2013.01)

(58) Field of Classification Search
CPC ..... F24C 13/00; F24C 13/327
USPC ..... 125/5, 369, 20, 273 R; 126/5, 369, 20, 126/273 R
See application file for complete search history.

(56) References Cited

U.S. PATENT DOCUMENTS 4,502,371 A * 3/1985 Di Lascio ..... A47J 31/30 126/369
6,823,859 B2 * 11/2004 Yamada ..... F24C 3/067 126/39 J
7,669,591 B2 * 3/2010 Fossati ..... A47J 27/04 126/348
2006/0108433 A1 5/2006 Fossati et al.
2010/0282237 A1 * 11/2010 Atkinson ..... F24C 3/126 126/39 E
2012/0031283 A1 2/2012 Kang et al.

FOREIGN PATENT DOCUMENTS

EP 2405202 A1 * 1/2012 ..... A21B 3/04

* cited by examiner

*Primary Examiner* — Avinash Savani
*Assistant Examiner* — Aaron Heyamoto
(74) *Attorney, Agent, or Firm* — Dentons US LLP

(57) ABSTRACT

A cooking appliance includes a case, a cooktop at an upper part of the case, including a heating source, a cavity in the case, including a cooking chamber for cooking foods, a steam generator receiving heat from the heating source to generate steam, and a steam flow part having one end connected to the steam generator and another end connected to the cooking chamber to guide the steam generated from the steam generator to the cooking chamber.

18 Claims, 7 Drawing Sheets

COOKING APPLIANCE

CROSS-REFERENCE TO RELATED APPLICATIONS

The present application claims priority under 35 U.S.C. 119 and 35 U.S.C. 365 to Korean Patent Application No. 10-2014-0163278 (filed on Nov. 21, 2014), which is incorporated by reference in its entirety for all purposes as if fully set forth herein.

BACKGROUND

The present disclosure relates to a cooking appliance.

In general, as heating devices used to cook foods, there are microwave ovens that use a high frequency, gas ovens and electric ovens each of which directly apply heat to foods by using a heater, and steam cooking appliances that supply heat to food by using steam.

Here, in the microwave ovens, the food is dried after being cooked, and thus the food does not taste good any more. Also, the gas and electric ovens may increase in cooking time due to a relatively low coefficient of heat transfer of air to deteriorate cooking efficiency.

However, in the steam cooking appliances, appropriate moisture is maintained within foods to maintain the taste of cooked foods. Also, since the steam cooking appliances use steam having excellent coefficient of heat transfer as a heat transfer medium, the steam cooking appliances may be reduced in cooking time and be excellent in cooking efficiency.

Also, the steam cooking appliance includes a steam generator for generating steam to be supplied to a cooking chamber.

The steam generator has a complicated structure, and thus it is difficult to clean the inside of the steam generator. Also, if a consumer does not regularly clean the steam generator, scale may be generated inside the steam generator. The scale may cause efflorescence in which a white stain is generated inside the cooking chamber.

The prior art of the present disclosure is disclosed in Korea Patent Publication No. 10-2012-0122141.

SUMMARY

Embodiments provide a cooking appliance having a simple structure and capable of minimizing generation of scale inside thereof.

In one embodiment, a cooking appliance includes: a case; a cooktop at an upper part of the case, comprising a heating source; a cavity in the case, comprising a cooking chamber for cooking foods; a steam generator to receive heat from the heating source and to generate steam; and a steam flow part having one end connected to the steam generator and another end connected to the cooking chamber to guide the steam generated from steam generator to the cooking chamber.

In another embodiment, a cooking appliance includes: a cooktop including a heating source; an oven under the cooktop, comprising a cooking chamber for cooking foods; a control panel to control operation of the oven; a steam generator on the cooktop to receive heat from the heating source, thereby generating steam; and a steam flow part on the control panel to guide steam generated from the steam generator to the cooking chamber.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
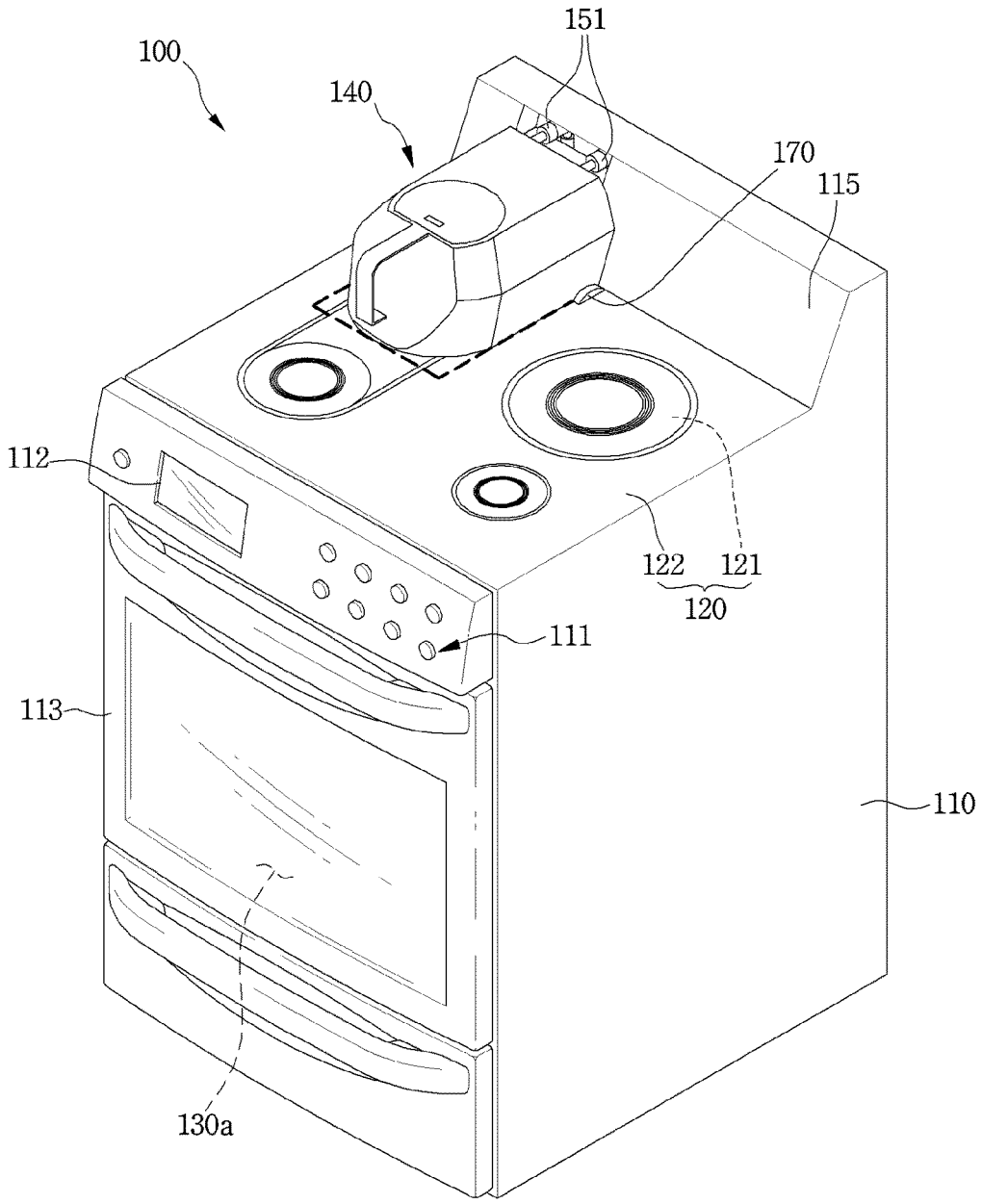
FIG. 1 is a perspective view of a cooking appliance according to an embodiment.
Figure 2:
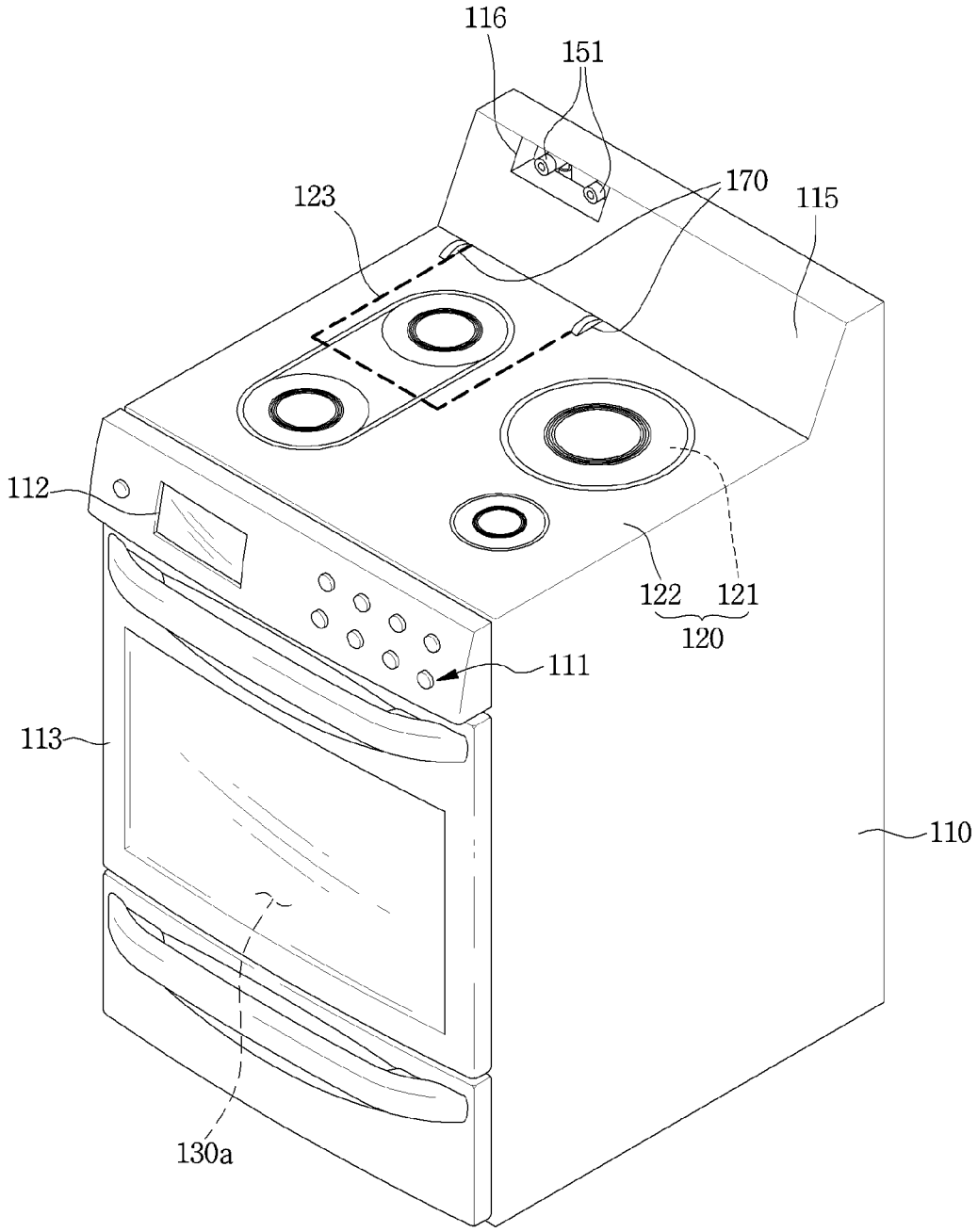
FIG. 2 is a perspective view illustrating a state in which a steam generator is separated from the cooking appliance of FIG. 1.
Figure 3:
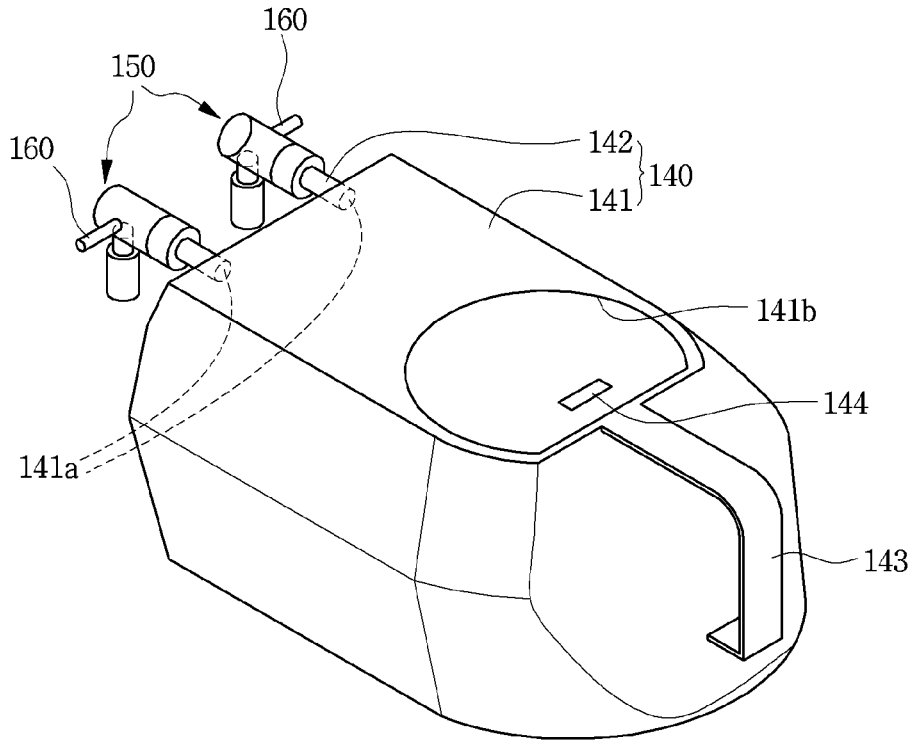
FIG. 3 is an enlarged perspective view of the steam generator and a steam flow part of the cooking appliance of FIG. 1.
Figure 4:
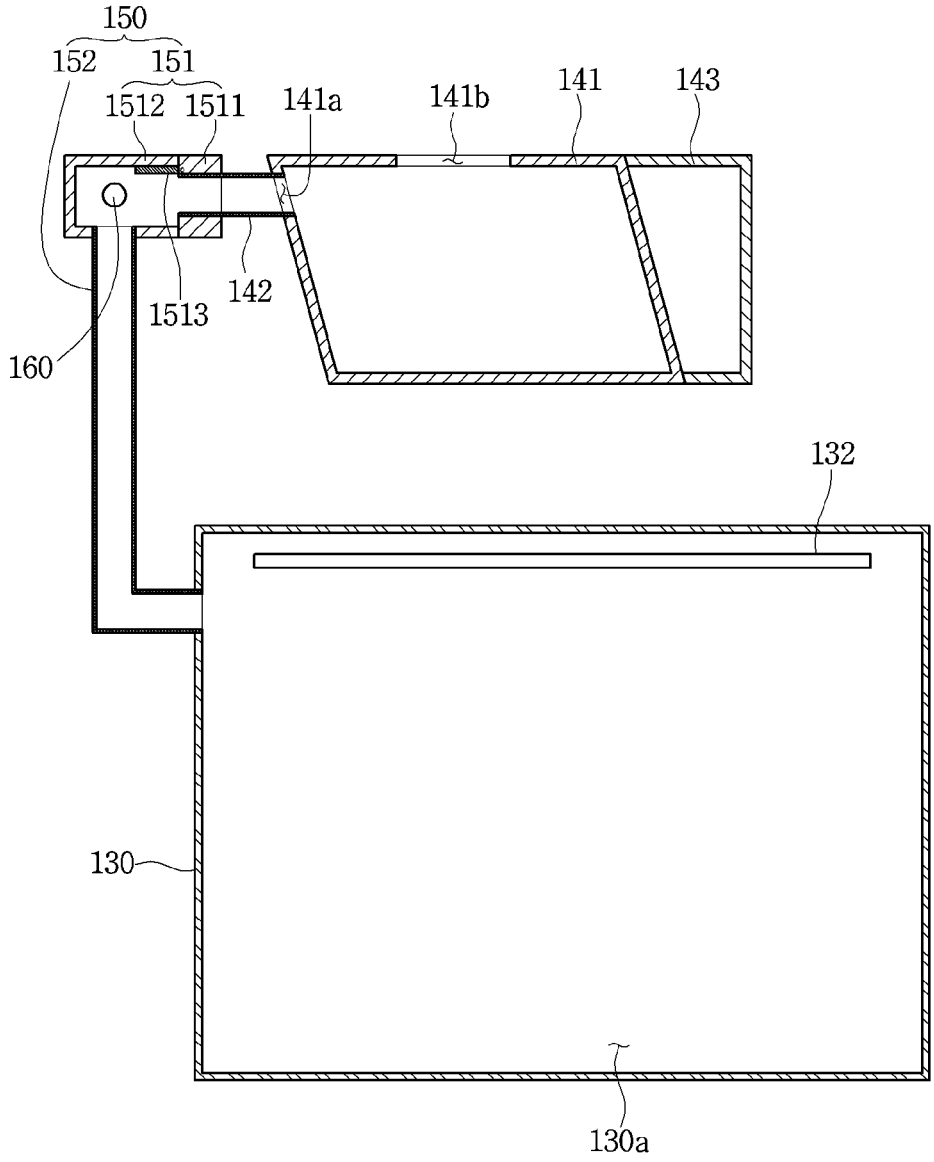
FIG. 4 is a schematic view illustrating a cavity, the steam generator, and the steam flow part of the cooking appliance of FIG. 1 are connected to each other.
Figure 5A:
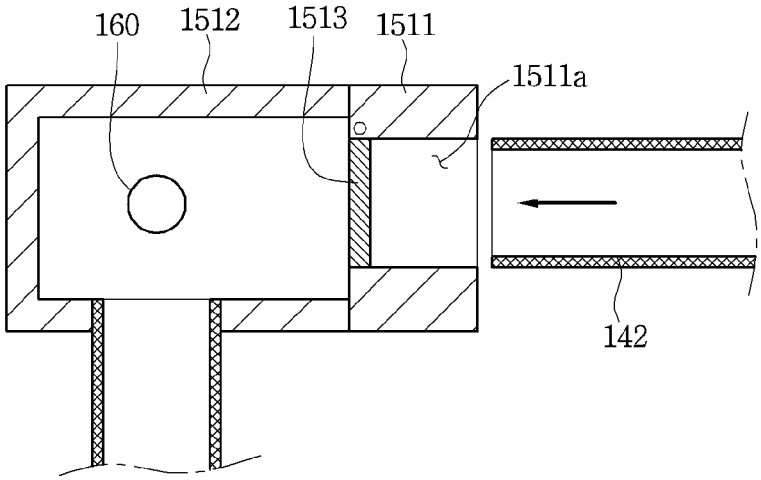
FIGS. 5A to 5C are views illustrating operating relation between a block film and a joint tube of the cooking appliance of FIG. 1.
Figure 5B:
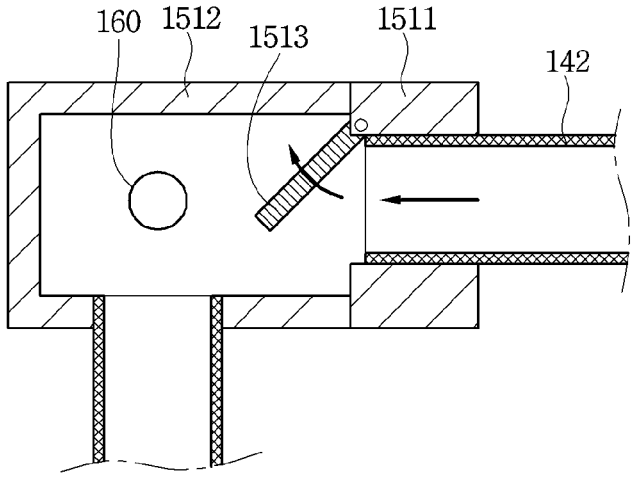
Figure 5C:
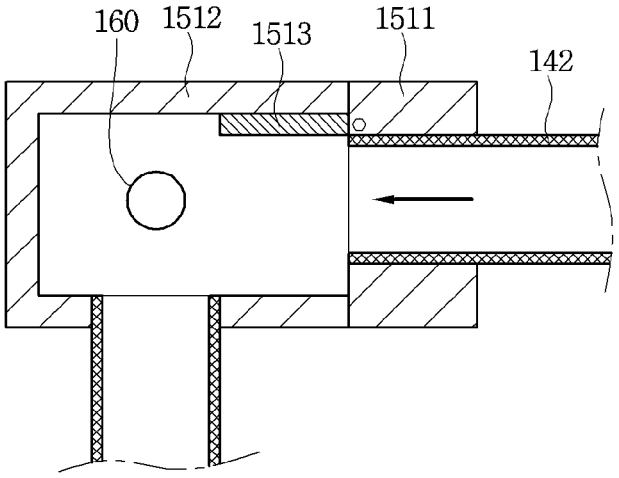

FIG. 1 is a perspective view of a cooking appliance according to an embodiment, and FIG. 2 is a perspective view illustrating a state in which a steam generator is separated from the cooking appliance of FIG. 1, and FIG. 3 is an enlarged perspective view of the steam generator and a steam flow part of the cooking appliance of FIG. 1. Also, FIG. 4 is a schematic view illustrating a cavity, the steam generator, and the steam flow part of the cooking appliance of FIG. 1 are connected to each other, and FIGS. 5A to 5C are views illustrating operating relation between a block film and a joint tube of the cooking appliance of FIG. 1.

Referring to FIGS. 1 to 5C, a cooking appliance 100 according to an embodiment may include a case 110, a cooktop part 120, a cavity 130, a steam generator 140, and a steam flow part 150.

The case 110 may define an outer appearance of the cooking appliance 100. Also, the cavity 130 is disposed in the case 110. The steam flow part 150 may be disposed at one side of the case 110.

A control panel 115 including an input part determining an operation method of a heating source 132 for cooking food accommodated in the cavity 130 may be disposed on the case 110. At least one portion of the steam flow part 150 may be disposed on the control panel 115. The control panel 115 may be disposed at a rear side of a top surface of the cooktop part 120 to extend upward from the cooktop part 120.

A door 113 that opens and closes a cooking chamber 130*a* of the cavity 130 may be disposed on the case 110.

In the present disclosure, the heating source 132 for providing heat to the cavity 130, the door 113, and the cavity 130 may be called an "oven part" in total.

Also, an adjusting part 111 capable of adjusting intensity of current supplied to a heating source 121 of the cooktop part 120 may be disposed on the case 110.

Thus, a user may adjust the intensity of current supplied to the heating source 121 through the adjusting part 111 to adjust a temperature at which the heating source 121 heats the steam generator 140 disposed on the cooktop part 120.

Also, a display part 112 may be disposed on the case 110.

The display part 112 may display information about whether the steam generator 140 is connected to the steam flow part 150 and information about a temperature of the cooktop part 120 or a temperature of the steam generated from the steam generator 140.

The cooktop part 120 disposed on the case 110 may include the heating source 121 and a top plate 122 disposed above the heating source 121.

The top plate 122 may be disposed on the case 110. The top plate 122 may be formed of ceramic glass.

Also, a cooking object, a container in which the cooking object is accommodated, or the steam generator 140 may be seated on a top surface of the top plate 122.

Also, a pattern 123 that represents a point on which the steam generator 140 is seated may be provided on the top surface of the top plate 122. The pattern 123 may correspond to an outer edge of a bottom surface of the steam generator 140. The pattern 123 may be represented with a solid or dotted line.

At least one heating source 121 is provided on a lower portion of the top plate 122 to provide the heat to the steam generator 140 or the container, which is seated on the top surface of the top plate 122. Here, at least one portion of the steam generator 140 may vertically overlap the heating source in a state where a joint tube of the steam generator 140 is connected to the steam flow part.

Also, the heating source 121 may be a radiant heater or an inductive heater.

The cavity 130 is disposed in the case 110 and includes the cooking chamber 130*a* for cooking the foods therein.

The cooking chamber 130*a* for cooking the foods by using steam is defined in the cavity 130. The steam necessary to cook the foods may flow to the cooking chamber 130*a* through the steam flow part 150.

The steam generator 140 may receive the heat from the cooktop part 120 to heat water, thereby generating steam.

In the cooking appliance 100 according to the current embodiment, since the steam generator 140 receives the heat from the cooktop part 120, it is unnecessary to provide a separate heating device for providing the heat to the steam generator 140. Thus, the cooking appliance 100 may be simplified in structure and easy for maintenance.

Also, the steam generator 140 may be selectively seated on the cooktop part 120. That is, since the steam generator 140 is detachable from the cooktop part 120, the user may separate the steam generator 140 from the cooktop part 120 to clean the steam generator 140 or to introduce the water into the steam generator 140.

The steam generator 140 may include a steam container 141 and a joint tube 142.

An exhaust hole 141*a* through which the steam generated inside the steam container 141 is exhausted is defined in the steam container 141.

In detail, the steam container 141 may be seated on the top plate 122 of the cooktop part 120 to receive the heat from the heating source 121 of the cooktop part 120, thereby heating the water therein and generating the steam.

Also, the steam generated from the inside of the steam container 141 may be exhausted to the outside through the exhaust hole 141*a* defined in one side of the steam container 141.

The joint tube 142 extends from the exhaust hole 141*a*. A flow path through which the steam flows may be defined in the joint tube 142.

That is, since the joint tube 142 has one end that communicates with the exhaust hole 141*a*, the steam generated from the inside of the steam container 141 may flow into the joint tube 142 through the exhaust hole 141*a*.

The joint tube 142 had the other end that is selectively connected to the steam flow part 150 to transfer the steam to the steam flow part 150.

Also, a water inlet 141*b* through which the water is introduced into the steam container 141 may be defined in the steam container 141. Also, a cover 144 that selectively opens and closes the water inlet 141*b* may be disposed on the steam container 141.

To promote the convenience of the user, a handle 143 may be further disposed on the steam container 141.

The steam flow part 150 may have one end that is selectively connected to the steam generator 140 and the other end that is connected to the cooking chamber 130*a* to guide the steam generated from the steam generator 140 to the cooking chamber 130*a*.

The steam flow part 150 may include a docking part 151 and a connection tube 152.

The docking part 151 is selectively connected to the exhaust hole 141*a*.

In detail, the joint tube 142 may be inserted into the docking part 151. When the joint tube 142 is inserted into the docking part 151, the docking part 151 may communicate with the exhaust hole 141*a*. Here, in a state where the steam generator 140 is disposed on the cooktop part 120, the joint tube 142 of the steam generator 140 is aligned with the docking part 151. Thus, the steam generator 140 may slide toward the docking part 151 to allow the joint tube 142 to be connected to the docking part 151.

A recessed part 116 is defined in the control panel 115. A portion of the docking part 151 may be disposed in the recessed part 116. In this case, since the docking part 151 does not protrude to the outside of the control panel 115, a phenomenon in which the docking part 151 is damaged may be prevented.

The docking part 151 may include a first member 1511 and a second member 1512.

An insertion hole 1511*a* is defined in the first member 1511 so that the joint tube 142 is inserted into the insertion hole 1511*a*. The second member 1512 guides the steam transferred from the first member 1511 to the connection tube 152.

Also, the docking part 151 may further include a blocking member 1513.

The blocking member 1513 may be disposed in the insertion hole 1511*a* of the first member 1511 to selectively block the insertion hole 1511*a*. Alternatively, the blocking member 1513 may be disposed on the second member 1512 to selectively block the insertion hole 1511*a*.

In more detail, the blocking member 1513 may open the insertion hole 1511*a* when the joint tube 142 is inserted into the insertion hole 1511*a*. For this, the blocking member 1513 may be rotatably coupled to one side of the first member 1511.

When the joint tube 142 presses the blocking member 1513 while being inserted into the insertion hole 1511*a*, the blocking member 1513 may rotate to open the insertion hole 1511*a*.

Like this, since the blocking member 1513 opens the insertion hole 1511*a* only when the connection tube 142 is inserted into the insertion hole 1511*a*, a phenomenon in which foreign substances are introduced into the insertion hole 1511*a* may be prevented.

The connection tube 152 has one end that is connected to the second member 1512 of the docking part 151 and the other end that is connected to the cooking chamber 130*a* to guide the steam transferred from the docking part 151 to the cooking chamber 130*a*.

The cooking appliance 100 may further include a temperature sensor 160 that is disposed on at least one of the first and second members 1511 and 1512 to measure a temperature of the steam.

Temperature information of the steam measured by the temperature sensor 160 may be displayed through the display part 112 disposed on the case 110.

Thus, the user may adjust the adjusting part 111 on the basis of the temperature information of the steam displayed on the display part 112 to adjust the temperature of the steam.

The docking part 151 may be disposed at an upper rear side of the cooktop part 120.

Also, the cooking appliance 100 may further include a guide part 170 disposed on the cooktop part 120 or the steam flow part 150.

The guide part 170 may guide an operation in which the steam container 141 is seated on the cooktop part 120 so that the joint tube 142 extending from the exhaust hole 141*a* is connected to the docking part 151.

Hereinafter, an operation of the cooking appliance will be described.

First, the water may be introduced into the steam container 141 through the water inlet. Also, the steam container 141 may be seated on the cooktop part 120.

When the steam container 141 is seated on the cooktop part 120, the guide part 170 may guide the position of the steam container 141 on the top surface of the cooktop part 120, that is, on the top surface of the top plate 122 so that the joint tube 142 is connected to the docking part 151.

When the exhaust hole 141*a* is connected to the docking part 151, information representing that the exhaust hole 141*a* is connected to the docking part 151 may be displayed on the display part 112.

Also, the heating source 121 may transfer the heat to the top plate 122, and the heat passing through the top plate 122 may be transferred to the steam container 141.

The heat transferred to the steam container 141 may be provided to the water to generate the steam.

When the exhaust hole 141*a* is connected to the docking part 151, more particularly, when the joint tube 142 extending from the exhaust hole 141*a* is inserted into the insertion hole 1511*a* of the first member 1511, the blocking member 1513 may rotate to allow the insertion hole 1511*a* to be in an opened state.

Thus, the steam generated from the steam container 141 may be introduced into the first member 1511 via the joint tube 142 through the exhaust hole 141*a*.

The temperature of the steam introduced into the first member 1511 may be measured by the temperature sensor 160. The steam may flow into the cooking chamber 130*a* in the cavity 130 through the second member 1512 and the connection tube 152.

The temperature information of the steam measured by the temperature sensor 160 may be provided to the user through the display part 112. Thus, the user may adjust the adjusting part 111 to increase or decrease the temperature of the steam on the basis of the present temperature of the steam.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a case;

a cooktop at an upper part of the case, comprising a top plate on which a cooking object or a container to accommodate the cooking object can be seated, and a first heating source;

a cavity in the case, comprising a cooking chamber for cooking foods;

a second heating source to provide heat to the cavity;

a control panel to adjust operation of the second heating source for cooking the foods in the cavity;

a steam generator to receive heat from the first heating source and to generate steam; and a steam flow part in the control panel and having one end connected to the steam generator and another end connected to the cooking chamber to guide steam generated from the steam generator to the cooking chamber, wherein if the cooking object or the container is seated on the top plate, the first heating source provides heat to the cooking object or the container, and wherein if the steam generator is seated on the top plate, the first heating source provides heat to the steam generator.

2. The cooking appliance according to claim 1, wherein the steam generator is detachable from the steam flow part.

3. The cooking appliance according to claim 1, wherein the steam generator comprises an exhaust hole through which the steam generated by the steam generator is exhausted, and wherein the exhaust hole selectively communicates with the steam flow part.

4. The cooking appliance according to claim 3, wherein the steam generator further comprises:

a steam container including the exhaust hole in a side thereof; and a joint tube having one end that extends from the exhaust hole and another end that is selectively connected to the steam flow part, wherein the joint tube includes a flow path through which the steam flows therein.

5. The cooking appliance according to claim 4, wherein the steam container further includes a water inlet.

6. The cooking appliance according to claim 4, wherein the steam generator further comprises a handle connected to the steam container.

7. The cooking appliance according to claim 4, wherein the steam flow part comprises:

a docking part selectively connected to the exhaust hole; and a connection tube having one end connected to the docking part and another end connected to the cooking chamber.

8. The cooking appliance according to claim 7, wherein the docking part comprises:

a first member having an insertion hole through which the joint tube is fixed; and a second member to guide the steam from the first member to the connection tube.

9. The cooking appliance according to claim 8, wherein the docking part further comprises a blocking member to selectively block the insertion hole, and wherein the blocking member opens the insertion hole when the joint tube is fixed in the insertion hole.

10. The cooking appliance according to claim 9, further comprising a temperature sensor on one of the first and the second members to measure a temperature of the steam.

11. The cooking appliance according to claim 8, further comprising a guide part on the cooktop or the steam flow part to locate the steam container on the cooktop so that the exhaust hole is connected to the docking part.

12. A cooking appliance comprising:

a cooktop comprising a first heating source and a top plate on which a cooking object or a container to accommodate the cooking object can be seated;

an oven under the cooktop, comprising a cooking chamber for cooking foods and a second heating source;

a control panel to control operation of the oven;

a steam generator that can be seated on the cooktop to receive heat from the first heating source, thereby generating steam; and a steam flow part on the control panel to guide steam generated from the steam generator to the cooking chamber, wherein if the cooking object or the container is seated on the top plate the first heating source provides heat to the cooking object or the container, and wherein if the steam generator is seated on the top plate, the first heating source provides heat to the steam generator.

13. The cooking appliance according to claim 12, wherein the steam generator comprises a joint tube connected to the steam flow part, and wherein a portion of the steam generator vertically overlaps the heating source.

14. The cooking appliance according to claim 13, wherein the steam flow part comprises a docking part to which the joint tube is connected, and wherein the joint tube is aligned with the docking part.

15. The cooking appliance according to claim 14, wherein the joint tube is fixed into the docking part by a sliding movement of the steam generator.

16. The cooking appliance according to claim 14, wherein the docking part comprises:

an insertion hole to which the joint tube is fixed; and a blocking member to block the insertion hole when the joint tube is separated from the docking part.

17. The cooking appliance according to claim 12, wherein the steam flow part comprises a docking part to which the steam generator is connected, wherein the control panel comprises a recessed part, and wherein the docking part is in the recessed part.

18. The cooking appliance according to claim 12, wherein a pattern for representing a position at which the steam generator is located is on the top plate.

* * * * *